United States Patent [19]

Fecker et al.

[11] 4,138,866

[45] Feb. 13, 1979

[54] YARN DELIVERY APPARATUS, ESPECIALLY FOR KNITTING MACHINES

[75] Inventors: Josef Fecker, Bisingen-Steinhofen; Gustav Memminger, Freudenstadt, both of Fed. Rep. of Germany

[73] Assignee: Firma Gustav Memminger-Verfanrenstechnik für die Maschenindustrie, Freudenstadt, Fed. Rep. of Germany

[21] Appl. No.: 773,666

[22] Filed: Mar. 2, 1977

[30] Foreign Application Priority Data

Mar. 2, 1976 [DE] Fed. Rep. of Germany ..... 2608590

[51] Int. Cl.[2] ..... D04B 15/48; B65H 51/20

[52] U.S. Cl. ..... 66/132 R; 242/47.01

[58] Field of Search ..... 66/132 R; 242/47.01

[56] References Cited

U.S. PATENT DOCUMENTS

| | | | |
|---|---|---|---|
| 3,709,444 | 1/1973 | Tannert | 242/47.12 X |
| 3,713,307 | 1/1973 | Muhlhausler | 242/47.12 X |
| 3,791,599 | 2/1974 | Jacobsson | 66/132 T X |
| 3,928,987 | 12/1975 | Jacobson | 242/47.01 X |
| 4,028,911 | 6/1977 | Fecker et al. | 66/132 R |

FOREIGN PATENT DOCUMENTS

| | | | |
|---|---|---|---|
| 2426680 | 5/1975 | Fed. Rep. of Germany | 66/132 R |
| 2419793 | 11/1975 | Fed. Rep. of Germany | 66/132 R |
| 1168905 | 10/1969 | United Kingdom | 66/132 R |
| 1373884 | 11/1974 | United Kingdom | 66/132 T |

*Primary Examiner*—Werner H. Schroeder
*Assistant Examiner*—Andrew M. Falik
*Attorney, Agent, or Firm*—Flynn & Frishauf

[57] ABSTRACT

To permit, selectively, positive feed or demand feed of yarn or thread to a utilization position of a textile machine, a rotating drum has a storage winding place thereon. A thread guide element is located laterally next to but below lower edge structure of the thread supply drum to permit drawing-off of yarn on the positive feed condition and preventing reverse winding of thread or yarn on the drum; additionally, a pull-off element is located either fixed, or rotatably about the axis of rotation of the drum in a plane which includes the axis of rotation of the drum below the bottom edge structure so that the thread or yarn can be selectively guided in a path inclined downwardly inclined exteriorally through the thread guide element 19 over the edge of the thread supply drum on in a different thread path over the pull-off element and then through the thread guide element.

12 Claims, 1 Drawing Figure

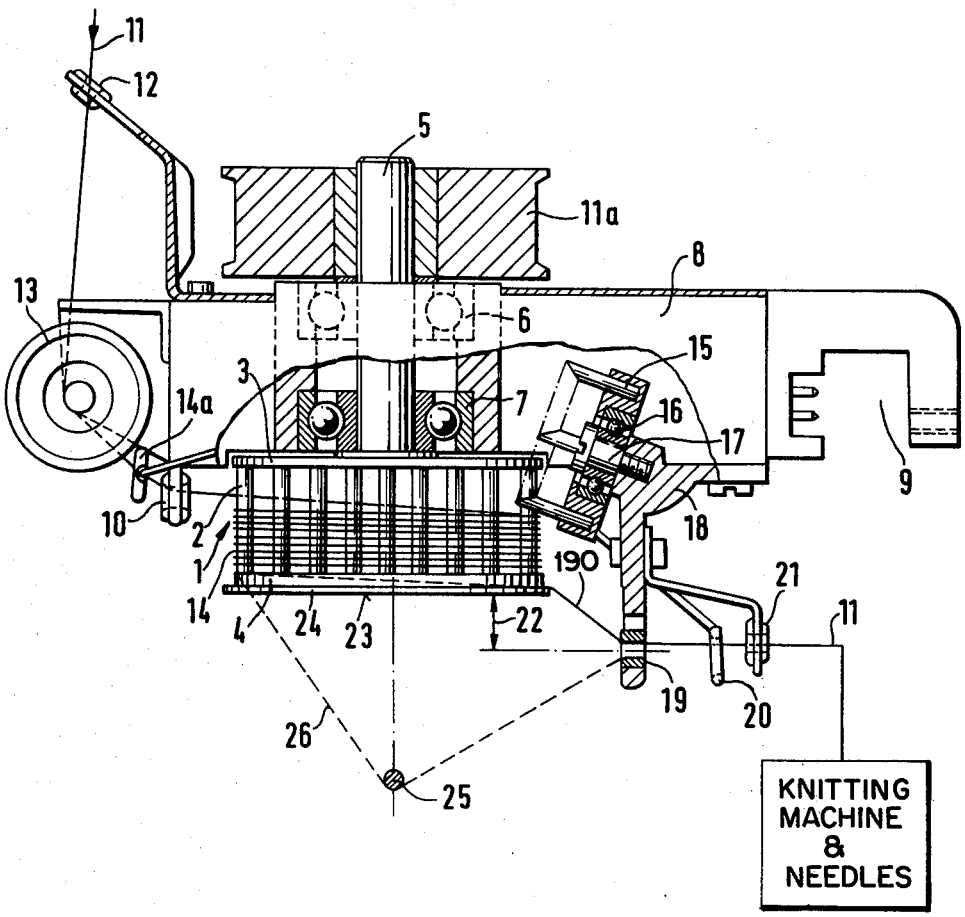
11
12
5
11a
8
13
6
15
3
7
16
14a
17
9
10
2
18
1
190
21
14
4
24
23
22
11
19
20
26
25
KNITTING MACHINE & NEEDLES

YARN DELIVERY APPARATUS, ESPECIALLY FOR KNITTING MACHINES

Cross reference to related patents assigned to the assignee of the present invention and showing thread supply drums and structures therefor:

U.S. Pat. No. 3,822,833, Fecker, July 1974;
U.S. Pat. No. 4,028,911, Fecker, June 14, 1977;
U.S. Pat. No. 4,056,239, Fecker, Nov. 1, 1977.

The invention relates to a thread supply apparatus for textile machines, and particularly for knitting machines.

BACKGROUND AND PRIOR ART

Various thread supply devices are known, e.g. of the type with a thread supply drum carrying a storage winding to which the thread can be supplied tangentially and from which the thread can be pulled off through a pull-off eye disposed laterally next to the thread supply drum at a thread pull-off speed corresponding to the speed of thread supply.

A thread supply apparatus is known, for example, from German Patent Publication DT-AS 1 760 600, where an adjustably disposed thread pull-off eye can be moved to an operating position where it will be positioned laterally next to the thread supply drum which corresponds to the so-called positive-operation of the thread supply apparatus. Only so much thread can be pulled off through the yarn pull-off eye thereby as there is supplied to the thread supply drum from the storage winding, that is, the thread pull-off speed is limited by the speed of thread supply. The thread pull-off eye is disposed above the lower edge structure of the thread supply drum in such a way that the yarn, lying approximately in a horizontal plane, runs tangentially off the thread supply drum.

In operation, for example when associated with a circular knitting machine equipped with thread supply apparatus of this type, it has been found, however, that difficulties arise in the selective use of yarns, i.e. yarns having, respectively, S-twist or Z-twist, depending on the respective direction of rotation of the thread supply drum. With slackening tension of the pulled off yarn, according to the direction of rotation of the thread supply drum, S-twisted or Z-twisted yarn can form loops between the pull-off eye and the yarn supply, which loops are wound up on the yarn or thread supply drum, which, in turn, leads to stoppage of yarn pull-off and thus to tearing of the yarn.

Basically similar problems in the selective use of yarns with S- or Z-twist also exist in another thread supply apparatus, as described, for example, in German Patent Publication DT-AS 2,341,498, where the thread is pulled off end-over-end from the thread supply drum over a pull-off eye coaxially disposed below the thread supply drum; in positive operation, a thread guide element is disposed near the edge of the thread supply drum in the thread path between the underside of the thread supply drum and the pull-off eye. This thread guide element, not completely enclosing the thread on all sides, is formed approximately in shape of a hook open on the side which holds the run off position of the thread fixedly in space away from the thread supply drum. If individual fibers should catch or snag, as when the yarn is pulled off end-over-end, more than one winding can simultaneously be pulled off from the thread supply drum, thereby developing a loop below the thread supply drum which leads to stoppage of the knitting machine. Depending on the respective direction of rotation of the thread supply drum, a perfect thread run-off is only possible with yarns which have either S- or Z-twist. A reversal of direction of rotation of the thread supply drum presupposes, however, that first of all the hook would have to be removed and reinstalled in reversed position, which is undesirable.

THE INVENTION

It is therefore the object of the invention to create a positive-acting thread supply apparatus in which, selectively, yarns with S- or Z-twist can be worked without any switch-over of parts.

The thread supply apparatus according to the invention comprises a pull-off eye element disposed laterally next to the thread supply drum and disposed by a predetermined distance below the lower edge structure of the thread supply drum, so that the thread being pulled off is directed through the pull-off eye element in a path inclined downwardly over the edge of the thread supply drum. Other thread guide eye elements known per se can also be used.

By guiding the running off thread inclined downwardly exteriorly over the edge of the thread supply drum, yarn loops which could possibly appear with slackening of the thread tension cannot be wound back up on the yarn supply drum. They remain, as experience has shown, below the bottom of the thread supply drum so that a blockage of the thread path cannot occur. Through this arrangement of the thread guide eye elements beyond the thread supply drum, simultaneous pull-off of more than one yarn winding from the thread supply drum is also prevented.

The distance by which the pull-off eye element is situated below the lower edge of the thread supply drum, depends on the dimensions of the thread supply drum and the thread supply apparatus together. It is to be chosen in such a way that the windings of the storage loop disposed on the thread supply drum do not drop off overhead, which would correspond to a negative-operation.

In order to avoid an undesired drop off of the thread windings of the storage loop due to incorrect setting of the pull-off loop, the thread supply drum preferably has a radially projecting ring shoulder at the lower edge over which the running off thread is guided.

The height or level adjustment of the thread pull-off eye element with respect to the thread supply drum can also be simplified in that the pull-off eye element is adjustably secured relative to the lower edge of the thread supply drum.

In case the thread supply apparatus is to work selectively also in the negative-operation, i.e. with a speed of thread pull-off independent of the speed of thread supply to the thread supply drum, the arrangement can be made in such a way that a pull-off element located below the thread supply drum is provided in the thread pull-off path between the thread supply drum and the lateral thread pull-off eye element, over which the thread can be selectively guided.

DRAWINGS, SHOWING AN EMBODIMENT

The single FIGURE shows a side view of the thread supply apparatus in part axial section.

The thread supply apparatus has a thread supply drum 1 formed as a pin-cage structure whose pins 2 are anchored with their ends in two end disks 3, 4 and disposed axially parallel to each other on a cylinder, not shown. The thread supply drum 1 with its end disk 3 is secured to a vertical drive shaft 5 which is rotatably journalled by ball bearings 6, 7 in a support holder 8 by which means of an attachment arrangement 9 can be placed on a suitable support ring, for example of a circular knitting machine. A pulley 11*a* is connected to the drive shaft 5 by which the shaft 5 can be rotated, for example over a flat belt by a drive source, not further shown.

Laterally next to the thread supply drum there is disposed at the level of its plane of circumference a lead-in thread eye 10 over which the thread 11 is guided tangentially on the rotating thread supply drum 1. The thread is derived from a supply spool, not further shown, after running through a first thread eye 12 and a thread brake 13 as well as the eye 14*a* of a stop-motion device.

A storage loop 14 is provided on the thread supply drum 1 consisting of several windings which is pushed downwardly by means of a feed element in form of a gear 15. The gear 15 engages in the manner shown in the FIGURE between the pins 2 of the thread supply drum 1; it is freely rotatably located by means of a ball bearing 16 on a shaft 17 connected to the support 8, so that it can be driven by the thread supply drum 1. Its shaft 17 is inclined with respect to the horizontal.

A thread pull-off eye is located laterally of the thread supply drum 1 on the side opposite the thread eye 10. Eye 19 is secured to a support element 18 which is screwed onto the support 8. Thread pull-off eye 19 has a horizontal axis and guides the thread 11 in a path 19D running off from the thread supply drum 1 to the eye 20 of a stop-motion device and a further thread eye 21 to knitting needles.

The thread pull-off eye 19 is positioned laterally adjacent to and by a predetermined amount 22 lower than the lower edge 23 of the thread supply drum 1. The thread supply drum 1 has its lower end disk 4 formed with a radially projecting ring flange 24 over whose rim edge the pay-out thread is pulled off in a path inclined downwardly from the pull-off eye 19.

A pull-off element 25 can be disposed coaxially to the thread supply drum 1 at a position in the prolongation of the axis of the thread supply drum 1. Element 25 may consist of a thread guide element rotatably located to rotate about the axis of the thread supply drum 1; or it may be positioned to be stationary below the thread supply drum 1. The thread running off from the thread supply drum can be guided over the element 25 in the thread path indicated at 26.

The thread pull-off eye 19 can be disposed height-adjustably on the support 18 in order to be able to simply adjust the distance 22 to the underside 23 of the thread supply drum 1, according to conditions.

Operation: (1) — Positive feed:

The thread coming from the supply spool, not shown, is guided through the thread eye 10 in the described manner to the rotating thread supply drum 1 and wound on the storage winding 14 from which the thread is pulled off in path 190 through the pull-off eye 19 at the same speed with which it is supplied at 10. The storage winding 14 always maintains the same size and is continuously pushed down by the gear 15 according to the thread pull off.

If the tension of the thread taken off through pull-off eye 19 should decrease and a thread loop form between the lower edge of the thread supply drum 1 and the pull-off eye 19, it cannot be wound on the thread supply drum 1. Rather, the thread loop remains in the region below the thread supply drum 1 until the thread utilization device again takes off the normal quantity of thread and the tension of the running off thread thus again reaches the normal value, so that the thread loop is eliminated.

The distance 22 of the pull-off eye element 19 from the bottom of the thread supply drum is so chosen or adjusted that, on the one hand, no windings of the storage winding 14 fall off over the end flange 24 of the thread supply drum and, on the other, the running off thread is pulled off over the lower edge of the thread supply drum or, as in the present case, of the ring flange 24. The eye element 19 thus can guide the thread by its upper wall, when operating normally, and by its lower wall, when the thread is slack and not pulled through the opening of element 19.

(2) — Negative, or demand feed:

In case the shown thread supply apparatus is to work selectively with a speed of thread pull-off independent of the speed of wind-up, i.e. the so-called negative-operation, the pull off element 25 is used. The thread is pulled off end-over-end, that is, over the bottom flange 24 of the drum 1. The thread is supplied to the drum 1 as before, but is then placed over the element 25 so that the thread path will be as shown in the broken line at 26. After passing over the element 25, the thread then continues through the guide eye 19.

Various changes and modifications may be made within the scope of the inventive concept.

We claim:

1. Thread supply apparatus particularly for knitting machines having needles comprising a rotatable thread supply drum (1) having a lower edge structure (24), and carrying a thread storage winding (14);

means (5, 11*a*) rotating the supply drum;

means (6-9) mounting said supply drum for rotation about a vertical axis;

thread supply means (10–13) guiding thread (11) to the drum (1) at an upper zone thereof to wind a plurality of storage windings (14) on the drum;

and pull-off guide means (19, 20, 21; 25) guiding thread being pulled off the drum from the lowest loop of the storage winding, comprising a thread guide eye element (19) fixed in position and located, with respect to the lower surface (23) of the lower edge structure (24) of the thread supply drum (1) laterally thereof and spaced therefrom, and therebelow, by a predetermined distance (22);

the thread guide eye element (19) having an opening to hold a thread (11) in essentially fixed position with repect to the lower edge structure (24) of the thread supply drum (1) and guide the thread with respect to a vertical direction, upwardly or downwardly, to restrain the thread from uncontrolled vertical movement;

and a pull-off element (25) located beneath the drum positioned in a general prolongation of the axis of the drum (1) and in a thread pull-off path between the thread supply drum and the thread guide eye element;

to permit selective removal of the threads from the drum (1)

(a) at a speed of thread pull-off corresponding to the speed of the thread supply through the guide eye element (19) located laterally next to, and below the thread supply drum (1) in a first thread path (190) bypassing the pull-off element (25) in its travel to the needles downwardly inclined over the lower edge structure (24) of the thread supply drum (1) and through the thread guide eye element (19); or (b) at the speed determined by needle demand in a second thread path (26), over the lower edge structure (24) of the drum to the the pull-off element (25) end-over-end with respect to the lower edge structure (24) of the drum and then upwardly through the thread guide eye element (19).

2. Thread supply apparatus according to claim 1, wherein the thread supply drum (1) has, at the lower edge, a radially projecting ring shoulder (24) over which the running off thread (11) is guided.

3. Thread supply apparatus according to claim 1, wherein the thread guide eye element (19) is adjustable in its height level relative to the lower edge (24) of the thread supply drum (1).

4. Thread supply apparatus according to claim 1, wherein the pull-off element (25) is a stationary element.

5. Thread supply apparatus according to claim 4, wherein the pull-off element (25) is located below the guide element (19) to guide the thread in said second path (190) to extend downwardly over the lower edge structure (24) of the drum, around the pull-off element (25) and upwardly and laterally of the drum to the guide elment (19).

6. Thread supply apparatus according to claim 2, wherein the pull-off element (25) is located below the guide element (19) to guide the thread in said second path (190) to extend downwardly over the lower edge structure (24) of the drum, around the pull-off element (25) and upwardly and laterally of the drum to the guide element (19).

7. Thread supply apparatus according to claim 3 wherein the pull-off element (25) is located below the guide element (19) to guide the thread in said second path (190) to extend downwardly over the lower edge structure (24) of the drum, around the pull-off element (25) and upwardly and laterally of the drum to the guide element (19).

8. Apparatus according to claim 1, wherein the axis of the thread guide element (19) opening extends horizontally.

9. Thread supply apparatus particularly for knitting machines having needles comprising a rotatable thread supply drum (1) having a lower edge structure (24) and carrying a thread storage winding (14);

means (5, 11*a*) rotating the supply drum;

means (6–9) mounting said supply drum for rotation about a vertical axis;

thread supply means (10–13) guiding thread (11) to the drum (1) at an upper zone thereof to wind a plurality of storage windings (14) on the drum;

and pull-off guide means (19, 20, 21; 25) guiding thread being pulled off the drum from the lowest loop of the storage winding comprising a thread guide eye element (19) fixed in position and located, with respect to the lower surface (23) of the lower edge structure (24) of the thread supply drum (1) laterally thereof and spaced therefrom and therebelow, by a predetermined distance (22);

the thread guide eye element (19) having an opening to hold the thread (11) in essentially fixed position with respect to the lower edge structure (24) of the thread supply drum (1) and guide the thread with respect to a vertical direction, upwardly or downwardly, to restrain the thread from uncontrolled vertical movement;

and a pull-off element (25) located beneath the drum in a thread pull-off path between the thread supply drum and the thread guide eye element positioned in a general prolongation of the axis of the drum (1) to guide the thread at the speed determined by needle demand in a thread path (26) over both the lower edge structure (24) of the drum and the pull-off element end-over-end with respect to the lower edge structure (24) of the drum and then through the thread guide eye element (19), the pull-off element being located below the guide eye element (19) whereby the thread path (26) will extend downwardly over the lower edge structure (24) of the drum, around the pull-off element (25) and upwardly and laterally of the drum to and through the guide eye element (19).

10. Apparatus according to claim 9, wherein the thread supply drum (1) has, at the lower edge, a radially projecting ring shoulder (24), over which the running off thread (11) is guided.

11. Apparatus according to claim 9, wherein the thread guide eye element (19) is adjustable in its height level relative to the lower edge (24) of the thread supply drum (1).

12. Apparatus according to claim 9, wherein the axis of the thread guide element opening (19) extends horizontally.

* * * * *